United States Patent [19]

Dlouhy

[11] Patent Number: 5,004,243

[45] Date of Patent: Apr. 2, 1991

[54] GOLF PRACTICE APPARATUS

[76] Inventor: Stephen J. Dlouhy, 101 Seven Oaks Road, Council Bluffs, Iowa 51503

[21] Appl. No.: 422,041

[22] Filed: Oct. 16, 1989

[51] Int. Cl.[5] ..... A63B 69/36

[52] U.S. Cl. ..... 273/195 A; 273/176 J

[58] Field of Search ..... 273/195 R, 195 A, 195 B, 273/201, 176 J, 196, 197 R, 197 A, 198, 32 R, 35 R

[56] References Cited

U.S. PATENT DOCUMENTS

| | | | |
|---|---|---|---|
| 1,276,775 | 3/1918 | Lambert | 273/33 |
| 2,266,558 | 12/1941 | Lich | 273/195 R |
| 2,790,640 | 7/1955 | Hoag | 273/33 |
| 3,348,847 | 10/1967 | Fischl | 273/186 |
| 3,561,764 | 2/1971 | Thomas | 273/183 |
| 3,586,335 | 6/1971 | D'Antonio, Sr. | 273/186 C |
| 3,599,982 | 8/1971 | Elesh | 273/195 A |
| 3,770,280 | 5/1972 | Strauss | 273/183 B |
| 3,880,432 | 4/1975 | Coffey et al. | 273/195 A |
| 4,346,896 | 8/1982 | Russell et al. | 273/195 A |
| 4,875,685 | 10/1989 | Ballinger et al. | 273/201 |

OTHER PUBLICATIONS

Wittek 1989-90 Golf Equipment Catalog.

*Primary Examiner*—George J. Marlo
*Attorney, Agent, or Firm*—John A. Beehner

[57] ABSTRACT

A durable golf practice apparatus that simulates actual golf conditions, including a base having a cavity, a mat, and a tee pad equal in thickness to that of said mat and the depth of said cavity. The tee pad may be repeatedly penetrated by a golf tee anywhere on its top surface and to any selective depth for removably receiving and supporting the tee. A golfer may place a ball on a golf tee, selectively adjust the height of the tee supported by the tee pad, and practice tee shots with any selected club. An artificial turf section may also be provided to allow fairway shots to be practiced.

14 Claims, 4 Drawing Sheets

GOLF PRACTICE APPARATUS

BACKGROUND OF THE INVENTION

The present invention is directed to a golf practice apparatus and more particularly to a durable and replaceable golf practice tee pad that allows a golfer to use conventional golf tees.

Golf is an exacting sport dependent largely on a players golf swing. In order to improve their golf swing many players, both amateur and professional, practice at golf driving ranges. There are several prior art devices such as Elesh, U.S. Pat. No. 3,599,982, and a device sold by Wittek as the "Drive-Master Series," that teach the use of a golf practice mat whereby golf course tee box and fairway conditions are partially simulated. While these devices are an improvement in that they are more durable than natural turf, they require the use of special tees, or have as their primary purpose a means for correcting a player's golf swing. Prior art devices representative of this genre are illustrated by Straus, U.S. Pat. No. 3,770,280, and Thomas, U.S. Pat. No. 3,561,764.

The device disclosed by Elesh, U.S. Pat. No. 3,599,982, utilizes special cylindrical rubber tees having opposing ends, one end being formed as a flexible pedestal for supporting the tee, and the other end being lipped and adapted for supporting a golf ball. Although such a special tee does act to tee a golf ball it also catches and damages the shaft and face of a golf club used to strike the ball resting on such a tee. Additionally, a player cannot readily adjust the teeing height of such a tee.

Proprietors of golf driving ranges are in need of an economical golf ball teeing means, and golfers are in need of a golf practice apparatus that will mimic actual playing conditions without damaging golf clubs.

The present invention teaches a durable apparatus capable of repeated and continued use that more closely simulates actual golf playing conditions.

Accordingly, a primary object of the invention is to provide an improved golf practice apparatus.

Another object of the invention is to provide a surface upon which a golfer may practice his or her golf swing.

Still another object of the invention is to provide a practice surface that simulates golf course conditions.

Still another object of the invention is to provide an apparatus that is economical to both golfers and the proprietors of driving ranges.

Yet another object of the invention is to provide an apparatus that does not increase golf club wear.

Yet another object of the invention is to provide a golf practice tee pad that is capable of supporting a conventional golf tee and golf ball combination.

Yet another object of the invention is to provide a golf practice tee pad that can be penetrated at numerous positions by a golf tee without reducing the pad's effectiveness for supporting a tee and golf ball combination.

SUMMARY OF THE INVENTION

The golf practice apparatus of the present invention includes a mat, or mat and base combination, for supporting a tee pad, whereby said tee pad is capable of being penetrated at numerous positions by a golf tee to any selective depth for removably receiving and supporting a golf tee. A golfer may insert a conventional golf tee into the tee pad, to a selected depth, in the same manner and fashion as a golfer would in teeing his or her golf ball at a golf course tee box.

A preferred means for supporting the tee pad is to provide a cavity in the mat, or mat and base combination, capable of receiving and supporting the tee pad.

A preferred embodiment of the present invention provides a portion of said mat having formed thereon an artificial turf surface for practicing golf iron shots.

DESCRIPTION OF THE PREFERRED EMBODIMENT

Figure 2:
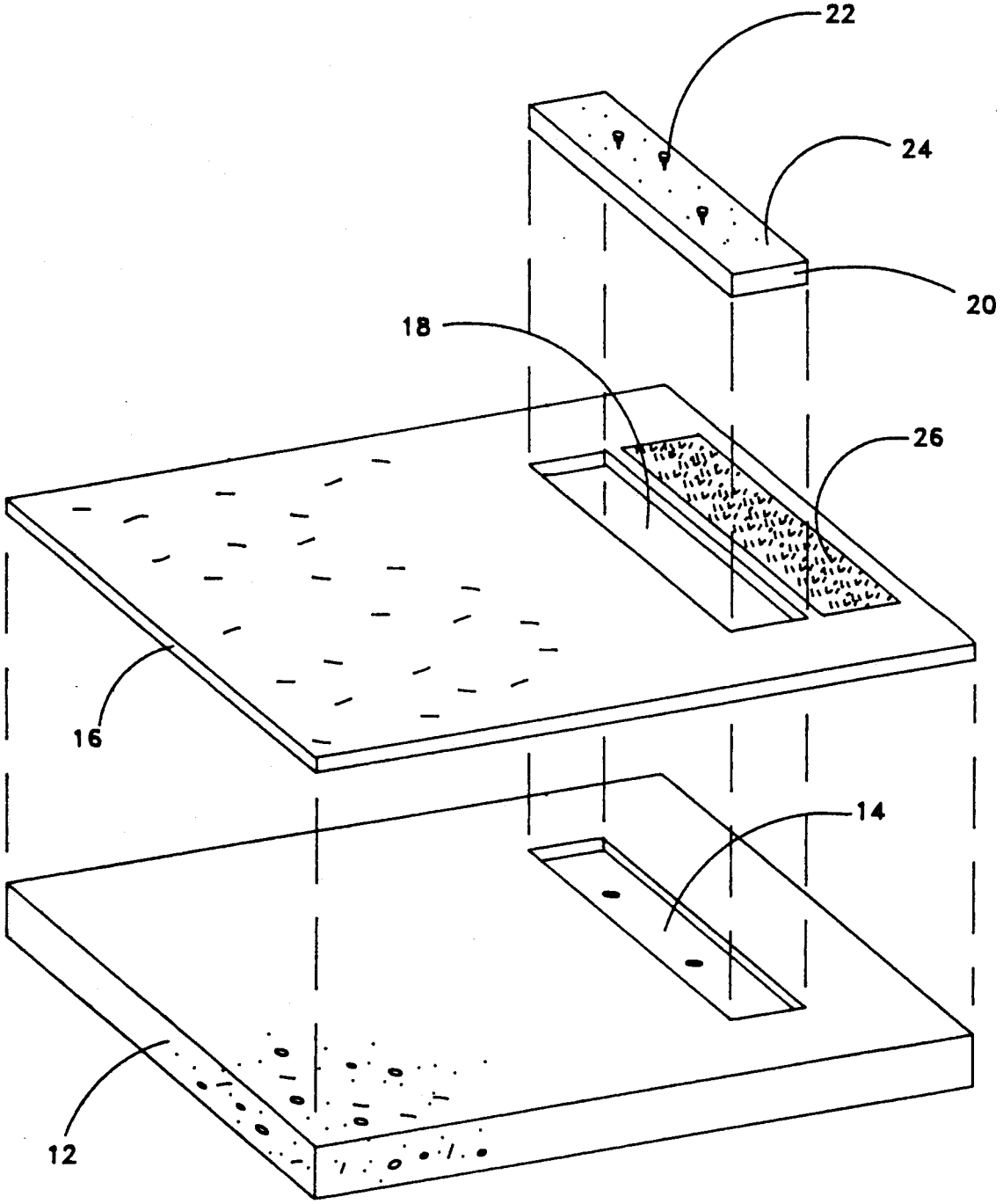
FIG. 2 is an exploded perspective view of a preferred embodiment of the golf practice apparatus.
Figure 1:
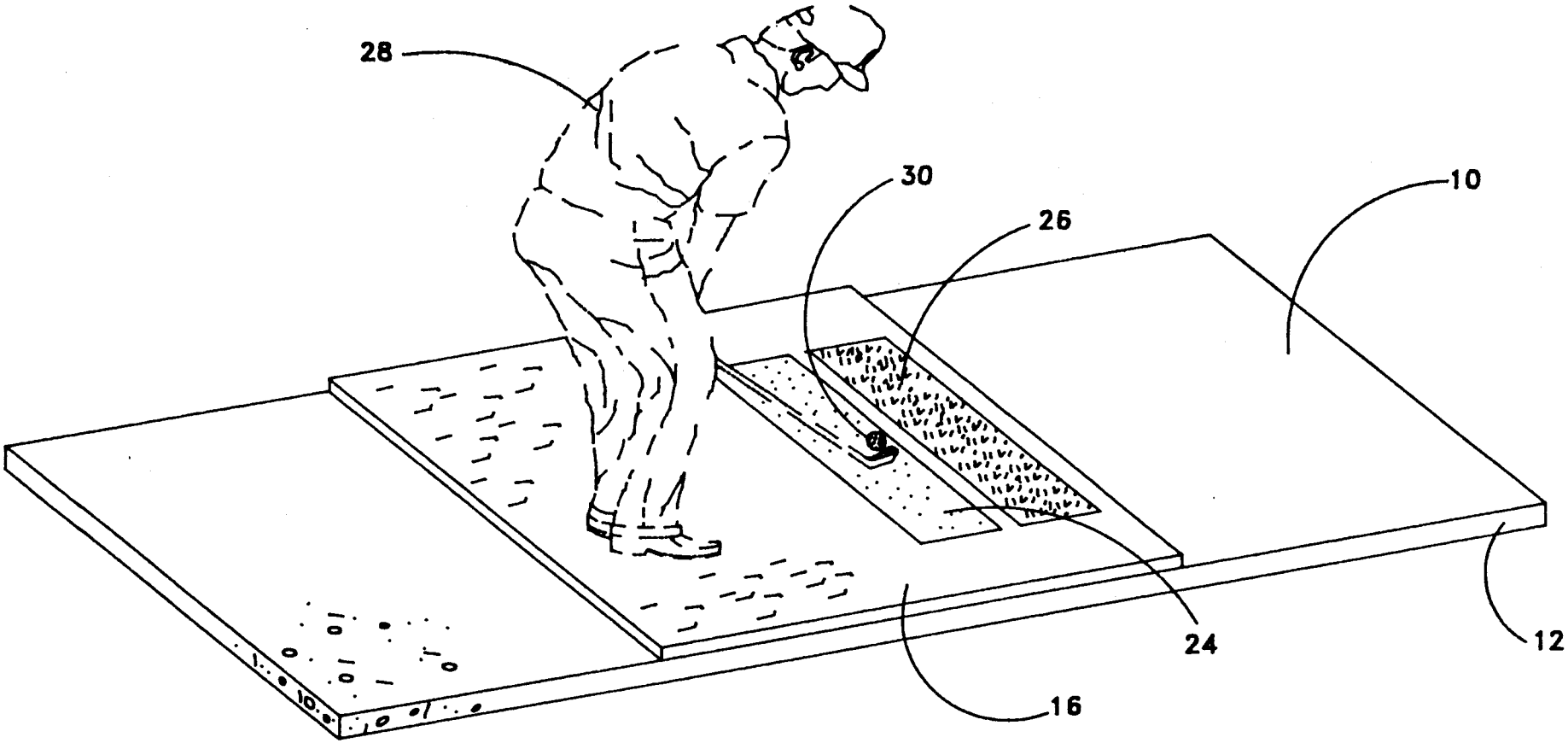
FIG. 1 is a perspective view of a preferred embodiment of the golf practice apparatus showing a golfer positioned to use the apparatus.
Figure 3:
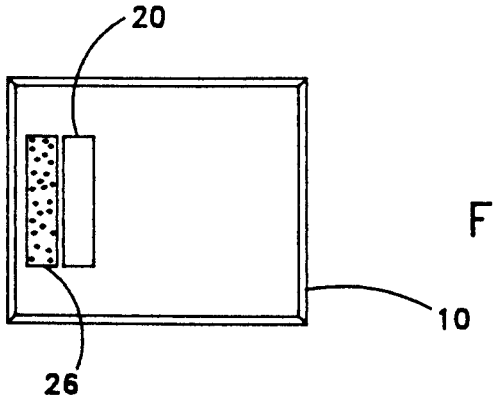
FIG. 3 is a top plan view of a preferred embodiment of the golf practice apparatus for a single golfer.
Figure 4:
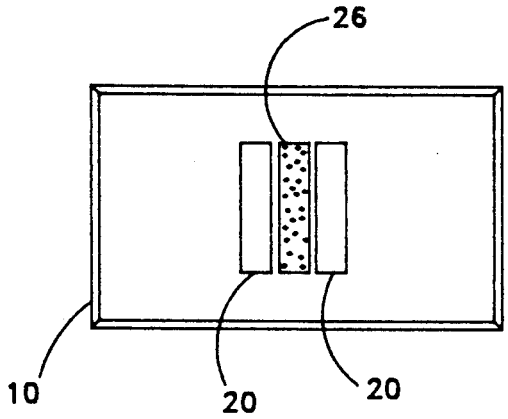
FIG. 4 is a top plan view of a preferred embodiment of the golf practice apparatus for use by both a left-handed or right-handed golfer.
Figure 5:
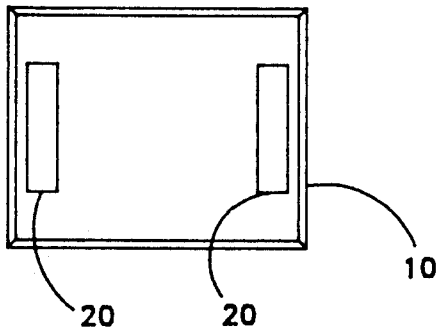
FIG. 5 is a top plan view of a preferred embodiment of the golf practice apparatus for use by both a left-handed or right-handed golfer.
Figure 6:
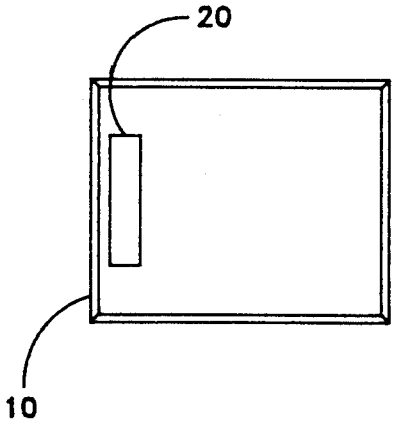
FIG. 6 is a top plan view of a preferred embodiment of the golf practice apparatus for a single golfer.
Figure 7:
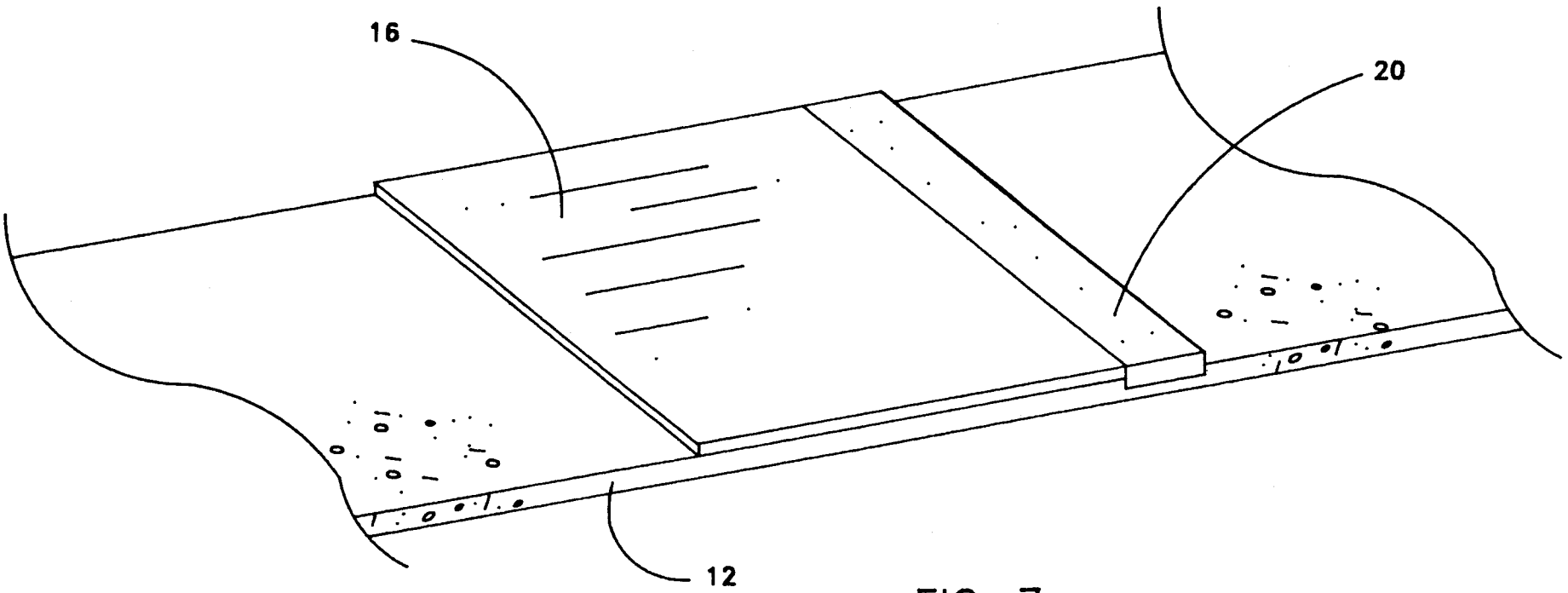
FIG. 7 is a perspective view of another preferred embodiment of the golf practice apparatus.

A golf practice apparatus 10, as shown in FIGS. 1, 2, and 3, includes a rigid support base 12 of reinforced concrete, having a cavity or trough 14 formed therein, and a mat 16 of a rubberlike substance having an opening 18 registerable with the base cavity 14.

The base cavity 14 and mat opening 18 are adapted for supporting and securing a tee pad 20.

Although the dimensions of the invention are not critical, a preferred embodiment has the following dimensions. The rigid support base 12 is 122 centimeters wide by 152 centimeters long by 10 to 15 centimeters high. The mat 16 is 122 centimeters wide by 152 centimeters long by 1.3 centimeters high. The base cavity 14 is 15 centimeters wide by 68 centimeters long by 5 centimeters high. The mat opening 18 is 15 centimeters wide by 68 centimeters long by 1.3 centimeters high. The tee pad 20 is 15 centimeters wide by 68 centimeters long by 6.4 centimeters high.

Said tee pad 20 is formed of a polyfoam material , such as the polyurethane foam available from Flexible Foam Products, P.O. Box 125, Bailey Road, Spencerville, Ohio 45887, capable of removably receiving and supporting a conventional golf tee 22, to any selected depth, at any position along the top surface of said tee pad 24.

An artificial turf sheet 26 such as a polypropylene turf brush sold by Wittek, 3650 Avondale Avenue, Chicago, Ill. 60618, or other type of artificial turf may be placed in another adjacent opening formed in said mat 16.

A mat opening 18 is adapted for supporting and securing tee pads 20, a second opening may be provided for supporting and securing an artificial turf sheet 26 adjacent to said mat opening.

A golfer 28 may insert a conventional golf tee 22 into the tee pad 20, place a golf ball 30 on said golf tee, and then practice his or her tee shots.

Where an artificial turf sheet 26 is provided a golfer 28 may place a golf ball 30 on said artificial turf sheet 26 so as to practice his or her iron shots from said golf practice apparatus 10.

Since tee shots are practiced with conventional tees 22, and the tee pad 20 is formed of an elastic material, practice conditions more closely resemble those found at a golf course. A golfer 28 may practice his or her swing with a golf ball teed to a wide range of heights.

The use of the tee pad 20 is both economical for the golfer 28 and driving range proprietor since the tee pad 20 may be repeatedly used over an extended period of time. When worn the tee pad 20 may be easily replaced. Additionally, since the tee pad 20 allows for the use of conventional golf tees 22, a golfer's clubs will not be damaged by the lipped surface of the prior art cylindrical rubber tees.

A golf driving range proprietor could have a plurality of golf practice stations providing areas for practice of both tee box and fairway shots.

Whereas the invention has been shown and described in connection with preferred embodiments thereof, many modifications, additions and substitutions may be made which are within the intended broad scope of the appended claims. For example, the mat 16 could be utilized in a configuration without a rigid support base 12, and the shape, finish, and proportions of any or all of the components of the apparatus could be changed or modified.

Thus, there has been shown and described a golf practice apparatus which accomplished at least all of the stated objectives.

I claim:

1. A golf practice apparatus for use on a rigid support base having a cavity formed therein comprising, a mat, a tee pad having upper and lower surfaces and a thickness generally equal to the depth of said support base cavity plus the thickness of said mat, said tee pad being operative to be penetrated at numerous positions on said upper surface by a golf tee to any selective depth for removably receiving and supporting said tee, and said tee being adapted for placement adjacent said mat whereby a ball on a tee supported by said pad is positioned to be struck by a club of a golfer on said mat.

2. The apparatus of claim 1 wherein said tee pad is operative to be penetrated by a golf tee at any position on the upper surface thereof.

3. The apparatus of claim 1 wherein said tee pad is formed of a polymer material.

4. The apparatus of claim 1 wherein said tee pad is formed of polyurethane foam.

5. The apparatus of claim 1 wherein said mat has operatively associated therewith an artificial turf sheet situated adjacent to said tee pad.

6. The apparatus of claim 1 whereby said tee pad, mat, and rigid support base are juxtaposed so as to allow both left-handed and right-handed golfers to strike a golf ball placed on said tee.

7. The apparatus of claim 1 wherein the thickness of said tee pad is substantially equal to the thickness of the mat plus the depth of the rigid support base cavity whereby the top surface of the tee pad is generally coplanar with the top surface of the mat.

8. A golf practice apparatus comprising, a mat having an opening therethrough, a tee pad having upper and lower surfaces, said tee pad being operative to be penetrated at numerous positions on said upper surface by a golf tee to any selective depth for removably receiving and supporting said tee, a base having a cavity formed therein, registrable with said opening in said mat for receiving and supporting said tee pad in said registered cavity and opening upon placement of said mat on said base with said opening registered with said cavity, said base, mat, and tee pad being so positioned to allow a golf ball on said tee to be struck by a club of a golfer on said mat.

9. The apparatus of claim 8 wherein said tee pad is operative to be penetrated by a golf tee at any position on the upper surface thereof.

10. The apparatus of claim 8 wherein said tee pad is formed of a polymer material.

11. The apparatus of claim 8 wherein said tee pad is formed of polyurethane foam.

12. The apparatus of claim 8 wherein said mat has a second opening therethrough parallel to said before mentioned opening, an artificial turf sheet, said artificial turf sheet registrable with said second opening in said mat.

13. The apparatus of claim 8 whereby said tee pad, mat, and base are juxtaposed so as to allow both left-handed and right-handed golfers to strike a golf ball placed on said tee.

14. The apparatus of claim 8 wherein the thickness of said tee pad is substantially equal to the thickness of the mat plus the depth of the cavity whereby the top surface of the tee pad is generally coplanar with the top surface of the mat.

* * * * *